US009682417B2

(12) United States Patent
Kido

(10) Patent No.: US 9,682,417 B2
(45) Date of Patent: Jun. 20, 2017

(54) BENDING DEVICE AND SPRING MANUFACTURING MACHINE

(71) Applicant: Shinko Machinery Co., Ltd., Osaka-shi, Osaka (JP)

(72) Inventor: Isao Kido, Osaka (JP)

(73) Assignee: Shinko Machinery Co., Ltd., Osaka-shi, Osaka (JP)

( * ) Notice: Subject to any disclaimer, the term of this patent is extended or adjusted under 35 U.S.C. 154(b) by 17 days.

(21) Appl. No.: 14/601,055

(22) Filed: Jan. 20, 2015

(65) Prior Publication Data

US 2015/0217361 A1 Aug. 6, 2015

(30) Foreign Application Priority Data

Feb. 4, 2014 (JP) ..... 2014-019578

(51) Int. Cl.
*B21F 35/02* (2006.01)
*B21F 3/027* (2006.01)
*B21D 11/10* (2006.01)

(52) U.S. Cl.
CPC ..... *B21F 35/02* (2013.01); *B21D 11/10* (2013.01); *B21F 3/027* (2013.01)

(58) Field of Classification Search
CPC .... B21F 3/02; B21F 35/02; B21F 3/04; B21F 3/08; B21F 35/00; B21F 35/04; B21D 11/10; B21D 11/06; B21D 3/10
USPC ..... 140/71 C
See application file for complete search history.

(56) References Cited

U.S. PATENT DOCUMENTS 4,718,265 A 1/1988 Post
5,349,838 A 9/1994 Latour
5,732,583 A 3/1998 Itaya
5,904,059 A * 5/1999 Perna ..... B21F 1/023 140/147
6,029,494 A 2/2000 Wu
6,142,002 A 11/2000 Itaya
6,151,942 A 11/2000 Itaya
(Continued)

FOREIGN PATENT DOCUMENTS

DE 19938905 A1 3/2000
DE 102011085005 A1 4/2013
(Continued)

OTHER PUBLICATIONS

Office Action for Japanese application No. 2014-019578 mailed May 12, 2015, 4 pages.
(Continued)

*Primary Examiner* — Moshe Wilensky
*Assistant Examiner* — Pradeep C Battula
(74) *Attorney, Agent, or Firm* — Rudy J. Ng; Bret E. Field; Bozicevic, Field & Francis LLP

(57) ABSTRACT

Provided is a bending device that includes a processing part having two protruding parts that protrude from an end surface of a pillar part and that bend a wire, a rotary part that supports the processing parts and rotates about an axis intersecting the length direction of the pillar part, an accommodating part that is cylindrical and accommodates the rotary part at an end part of the accommodating part so as to be rotatable, and a mechanism that rotates the accommodating part about an axis of the accommodating part.

7 Claims, 6 Drawing Sheets

(56) References Cited

U.S. PATENT DOCUMENTS

| | | | | |
|---|---|---|---|---|
| 7,134,305 | B2 * | 11/2006 | Wu | B21F 3/02 72/137 |
| 2004/0194525 | A1 | 10/2004 | Tsuritani | |
| 2010/0147048 | A1 | 6/2010 | Christofilis et al. | |
| 2011/0005633 | A1 * | 1/2011 | Itaya | B21F 35/00 140/102 |

FOREIGN PATENT DOCUMENTS

| | | | |
|---|---|---|---|
| EP | 0517637 | A1 | 12/1992 |
| EP | 0519865 | A1 | 12/1992 |
| JP | S61209726 | A | 9/1986 |
| JP | H08174120 | A | 7/1996 |
| JP | 2000061736 | A | 2/2000 |
| JP | 2000061737 | A | 2/2000 |
| JP | 200371533 | A | 3/2003 |
| JP | 2003-290859 | | 10/2003 |
| JP | 2004306076 | A | 11/2004 |
| JP | 2006167770 | A | 6/2006 |
| JP | 2009-274099 | | 11/2009 |
| WO | W09926739 | A1 | 6/1999 |
| WO | W02009077554 | A2 | 6/2009 |
| WO | W02009135845 | A1 | 11/2009 |

OTHER PUBLICATIONS

Extended European Search Report for European application No. 15153478.1 dated Jul. 8, 2015, 6 pages.

* cited by examiner

BENDING DEVICE AND SPRING MANUFACTURING MACHINE

CROSS-REFERENCE TO RELATED APPLICATIONS

This Nonprovisional application claims priority under 35 U.S.C. §119(a) on Patent Application No. 2014-019578 filed in Japan on Feb. 4, 2014, the entire contents of which are hereby incorporated by reference.

FIELD

The technology herein relates to a bending device provided with a cylindrical pin that bends a wire and a spring manufacturing machine provided with the bending device.

BACKGROUND AND SUMMARY

A spring manufacturing apparatus that processes a wire into a spring comprises a wire sending unit that sends out a wire and a tool disposed at an exit of the wire sending unit and processing the wire. When a coil spring is manufactured, a wire touches the tool (bending die) and a coil part is formed. On the coil spring, an appurtenant part is formed in addition to the coil part.

The appurtenant part is formed, for example, by bending the wire connecting with the end part of the coil part. One of the tools is a spindle that bends the wire. The spindle comprises a cylinder that is rotatable about the axis, a pivot provided at the center of an end surface of the cylinder, and a protruding part protruding from the end surface in a position away from the pivot.

In the spring manufacturing machine, the wire is engaged between the pivot and the protruding part, and the cylinder is rotated around the pivot to press the protruding part against the wire. The wire bends along the outer peripheral surface of the pivot.

The bending form of the bent part depends on the curvature of the outer surface of the pivot. For this reason, when a plurality of parts of the wire are bent in different bending forms, it is necessary to stop the processing once and change the spindle to another one having a pivot with a different curvature.

To avoid the change to another spindle, it is necessary that the spring manufacturing machine comprises a plurality of spindles in advance; however, the number of processing tools that can be attached to the frame of the spring manufacturing machine is limited and when the number of spindles is increased, it is necessary to detach other processing tool such as the bending die.

An example embodiment is made in view of such circumstances, and an object thereof is to provide a wire bending device and a spring manufacturing machine that are capable of bending a wire in a desired bending form without the need to change the spindle or increase the number of spindles.

A bending device according to the example embodiment comprises a processing part having two protruding parts that protrude from an end surface of a pillar part and that bend a wire, wherein at least one of the protruding parts has a curved surface part, and the wire is disposed between the two protruding parts, the pillar part is rotated around an axis of the pillar part to bend the wire along the curved surface part, the bending device comprises plural processing parts, curvature of the curved surface part of the protruding part in each processing part are different, and the bending device further comprises: a rotary part that supports the processing parts and rotates about an axis intersecting the length direction of the pillar part; an accommodating part that is cylindrical and accommodates the rotary part at an end part of the accommodating part so as to be rotatable; and a mechanism that rotates the accommodating part about an axis of the accommodating part.

In the bending device according to the example embodiment, the plural processing parts are installed next to each other around a rotation axis of the rotary part.

The bending device according to the example embodiment comprises: a cylindrical housing that supports the accommodating part so as to be rotatable about an axis of the accommodating part; and a tool attachment part that is provided on an end part of the housing and that a tool to processes the wire is attached to.

The bending device according to the example embodiment comprises a mechanism that moves the accommodating part in a direction in which the wire is supplied or in a direction intersecting the direction.

A spring manufacturing machine according to the example embodiment comprises: the bending device according to any of the above-described bending devices; a support wall that supports the bending device at one side and has an opening, wherein the wire is sent out from another side to the one side of the support wall through the opening.

In the example embodiment, the curvatures of the curved surface parts of a plurality of protruding parts are made different. The processing parts having the protruding parts are supported by the rotary part, and the rotary part is rotated to select one of the processing parts. By rotating the cylindrical accommodating part about the axis thereof, the wire is bent along the curved surface part of the selected protruding part.

EXAMPLE EMBODIMENTS

First Embodiment

Figure 1:
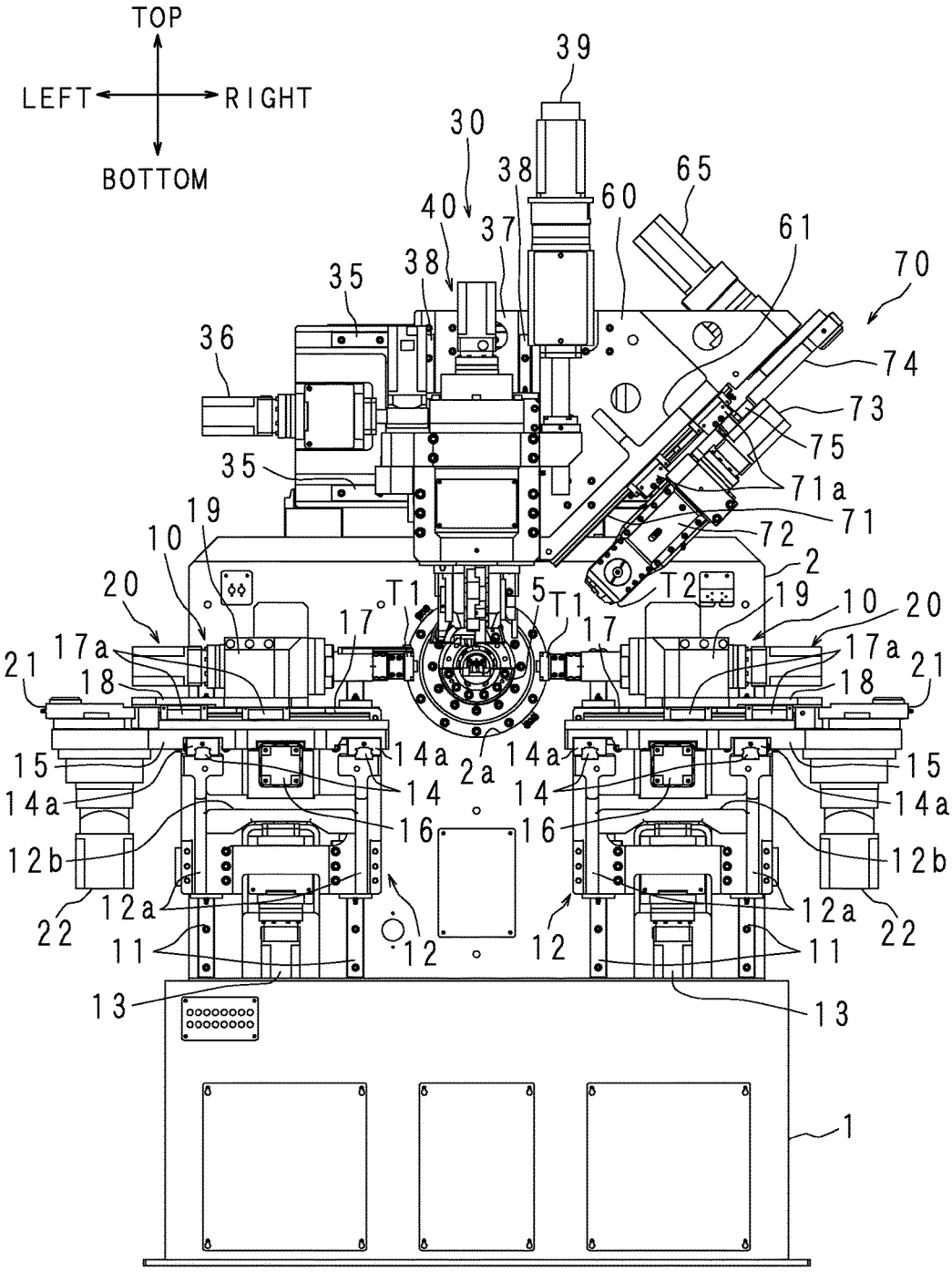
FIG. 1 is a front view briefly showing an example of non-limiting spring manufacturing machine according to a first embodiment.
Figure 2:
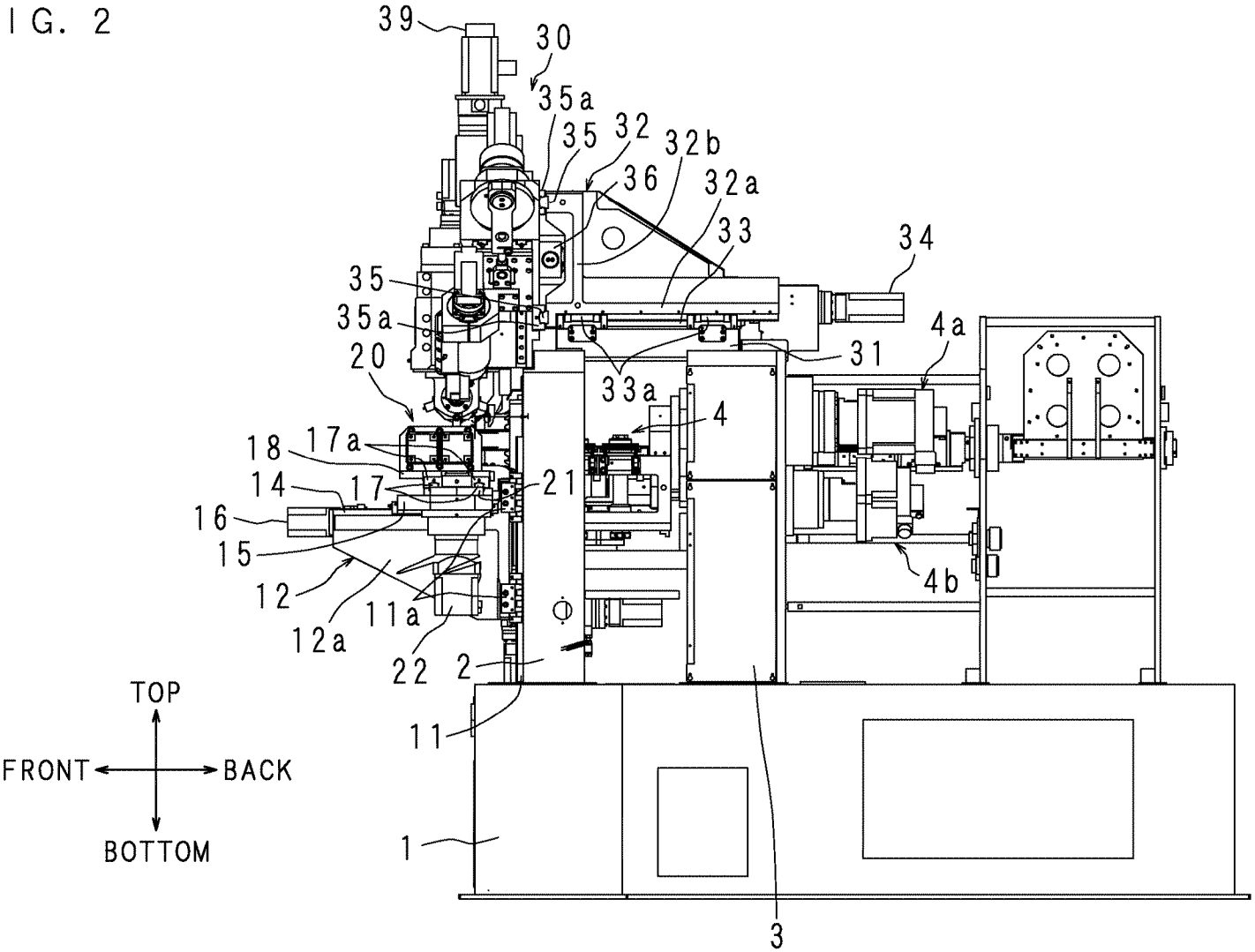
FIG. 2 is a right side view briefly showing an example of non-limiting spring manufacturing machine.

Hereinafter, the example embodiment will be described based on the drawings showing a spring manufacturing machine according to a first embodiment. In the following description, the top (up) and bottom (down), the right and left and the front and back indicated by the arrows in the drawings are used. Here, the front and the back correspond to the front surface and the rear surface, respectively. FIG. 1 is a front view briefly showing an example of non-limiting spring manufacturing machine, and FIG. 2 is a right side view briefly showing an example of non-limiting spring manufacturing machine.

The spring manufacturing machine comprises a base 1 that forms approximately rectangular parallelepiped, a front wall 2 provided upright on the base 1, and a rear wall 3 provided upright behind the front wall 2. In a central part of the front wall 2, an opening 2*a* passing therethrough in the front-back direction is provided. On the rear side of the front wall 2, a wire sending unit 4 that sends out the wire is provided. On the rear wall 3, a wire sending unit motor 4*a* and an axial rotation motor 4*b* are supported. The wire sending unit motor 4*a* drives the wire sending unit 4. The axial rotation motor 4*b* rotates the wire sending unit 4 about the axis of the wire. The wire sending unit 4 comprises a plurality of wire sending rollers that hold the wire between them and send out the wire. By the driving of the wire sending unit motor 4*a*, the wire sending rollers rotate, so that the wire is sent out forward. The wire sending unit 4 is capable of rotating about the axis of the wire by the driving of the axial rotation motor 4*b* with the wire held by the wire sending rollers.

Inside the opening 2*a*, a wire guide 5 that guides the wire sent out from the wire sending unit 4 is provided. The wire guide 5 has a semicylindrical shape with the front-back direction as the axial direction, and a groove is provided in the part of the axis. The wire guide 5 is capable of rotating about the axis. The wire sent out from the wire sending unit 4 passes through the groove to be guided forward.

On the front of the front wall 2, a pair of right and left tool devices 10 are supported. On an upper part of the front wall 2, a bending device 30 that bends the wire is supported.

The tool devices 10 supported on the left part on the front of the front wall 2 comprises a tool holding part 19 that holds the tool (a double spindle T1 in the present embodiment), a tool driving motor 20 that is provided on the tool holding part 19 and drives the double spindle T1, and mechanisms that move the tool holding part 19 upward, downward, rightward, leftward, backward and forward. The double spindle T1, the tool holding part 19 and the tool driving motor 20 are unitized. The mechanisms are provided side by side on the right and left on the front of the front wall 2, and respectively comprise two vertical direction rails 11 extending in the vertical direction. To each of the vertical direction rails 11, an upward and downward moving member 12 is coupled through a slider 11*a* so as to be movable upward and downward. The upward and downward moving member 12 comprises two side plate parts 12*a* and a table 12*b*. The two side plate parts 12*a* are parallel to each other and opposed in the left-right direction across a gap and that are respectively fixed on the vertical direction rails 11. The table 12*b* is laid so as to be horizontal between the two side plate parts 12*a*. The side plate parts 12*a* are coupled to the vertical direction rails 11 through the slider 11*a* so as to be movable. The upper end part of the side plate part 12*a* is larger in left-right width than the other part.

A vertical direction motor 13 is provided in a lower part of the left part on the front of the front wall 2. The vertical direction motor 13 is located below the table 12*b*. The vertical direction motor 13 is coupled to the table 12*b* through a ball screw mechanism. The rotation of the vertical direction motor 13 is converted to a movement in the vertical direction by the ball screw mechanism, so that the upward and downward moving member 12 moves upward or downward.

On the upper surface of each of the side plate parts 12*a*, two front-back direction rails 14 extending in the front-back direction are juxtaposed on the right and left. To the front-back direction rails 14, a backward and forward moving table 15 parallel to the front-back and left-right directions is coupled through a slider 14*a* so as to be movable backward and forward. The backward and forward moving table 15 and the table 12*b* are opposed so as to be separated in the vertical direction.

A front-back direction motor 16 is fixed to the upper surface of the table 12*b*. The front-back direction motor 16 is coupled to the backward and forward moving table 15 through a ball screw mechanism. The rotation of the front-back direction motor 16 is converted to a movement in the front-back direction by the ball screw mechanism, so that the backward and forward moving table 15 moves in the front-back direction along the front-back direction rails 14.

On the upper surface of the backward and forward moving table 15, two left-right direction rails 17 extending in the left-right direction are juxtaposed one behind another. The left-right direction rails 17 are each provided with a slider 17*a*. A coupling plate 18 is set on the slider 17*a*, and on the coupling plate 18, the tool holding part 19 is detachably attached. An end of the tool holding part 19 extends rightward, and to the end, the double spindle T1 that processes the wire is attached. The double spindle T1 is opposed to the opening 2*a* from the left side in a position in front of the opening 2*a*. On a left part of the tool holding part 19, the tool driving motor 20 that drives the double spindle T1 is provided. By the driving by the tool driving motor 20, the double spindle T1 is driven.

The double spindle T1 comprises, for example, a cylinder having a groove formed on an end surface thereof and a sleeve that is placed around an outer surface of the cylinder and that is rotatable about an axis thereof. A pin is provided on an end surface of the sleeve. The wire is engaged with the groove, and the sleeve is rotated to press the pin against the wire. The wire bends along the angular part of the groove.

A crank mechanism is provided on the backward and forward moving table 15. The crank mechanism comprises a rotary table 21 that is rotatable with the vertical direction as the rotation axis direction and a rod (not shown) that couples the rotary table 21 and the coupling plate 18. The rotary table 21 is located at the left end part of the backward and forward moving table 15. A left-right direction motor 22 is provided below the backward and forward moving table 15. The rotation shaft of the left-right direction motor 22 passes through the backward and forward moving table 15 and is coupled to the rotary table 21 in a position biased from the center of the rotary table 21. That is, the rotary table 21 rotates eccentrically. The rotary table 21 is coupled to the coupling plate 18 through the rod. The rotation of the left-right direction motor 22 is converted to a movement in the left-right direction by the eccentric rotary table 21 and the rod (crank mechanism), so that the tool holding part 19 moves in the left-right direction along the left-right direction rails 17 together with the double spindle T1. As mentioned above, the wire guide 5 is provided inside the opening 2*a*. The double spindle T1 contacts and separates from the wire guide 5 in the position in front of the opening 2*a*, is driven by the driving by the tool driving motor 20, and processes the wire sent out forward from the wire guide 5.

The structure of the tool devices 10 supported on the right part on the front of the front wall 2 is substantially the same as that of the tool devices 10 supported on the left part on the front of the front wall 2 except that the right and left positions thereof are different. Of the structure of the tool devices 10 supported on the right part on the front of the front wall 2, a structure similar to that of the tool devices 10 supported on the left part on the front of the front wall 2 is denoted by the same reference numeral and a detailed description thereof is omitted.

By providing the double spindle T1 on the right and left on the front of the front wall 2, the following can be performed: After the wire is held by one double spindle T1, the wire is cut by a cutter T2 attached to a tool holding part 72 described later and the wire held by the one double spindle T1 is bent by the other double spindle T1 from the cut side.

The following may also be performed: The tool holding part 19 is detached from the coupling plate 18, that is, the unitized tool holding part 19, double spindle T1 and tool driving motor 20 are detached from the coupling plate 18 and a different unit including a different tool (for example, a bending die or a cutter) is detachably attached to the coupling plate 18.

The bending device 30 comprises a bending unit 40 and a mechanism that moves the bending unit 40 upward, downward, rightward, leftward, backward and forward. The mechanism comprises a lower plate 31 extending in the front-back direction and laid above the front wall 2 and the rear wall 3 as shown in FIG. 2. On the upper surface of the lower plate 31, two front-back direction rails 33 extending in the front-back direction are juxtaposed on the right and left. To the front-back direction rails 33, a backward and forward moving member 32 is coupled through a slider 33*a* so as to be movable. The backward and forward moving member 32 comprises a table 32*a* extending in the front-back direction and a support plate 32*b* installed upright on the front end part of the table 32*a*. The table 32*a* and the lower plate 31 are opposed so as to be separated in the vertical direction. A front-back direction motor 34 is provided between the table 32*a* and the lower plate 31. The front-back direction motor 34 is fixed to the lower plate 31, and coupled to the table 32*a* through a ball screw mechanism. The rotation of the front-back direction motor 34 is converted to a movement in the front-back direction by the ball screw mechanism, so that the backward and forward moving member 32 moves in the front-back direction.

On the front of the support plate 32*b*, two left-right direction rails 35 extending in the left-right direction are juxtaposed one above the other. To the left-right direction rails 35, a left-right moving table 37 is coupled through a slider 35*a* so as to be movable in the left-right direction. The left-right moving table 37 and the support plate 32*b* are opposed so as to be separated in the front-back direction. A left-right direction motor 36 is provided between the left-right moving table 37 and the support plate 32*b*. The left-right direction motor 36 is fixed to the support plate 32*b*, and coupled to the left-right moving table 37 through a ball screw mechanism. The rotation of the left-right direction motor 36 is converted to a movement in the left-right direction by the ball screw mechanism, so that the left-right moving table 37 moves in the left-right direction.

On the front of the left-right moving table 37, two vertical direction rails 38 extending in the vertical direction are juxtaposed on the right and left. To the vertical direction rails 38, the bending unit 40 is coupled through a slider 38*a* (see FIG. 4 described later) so as to be movable in the vertical direction. The lower end part of the bending unit 40 is located on the front side of the opening 2*a*. To the bending unit 40, a vertical direction motor 39 is coupled through a ball screw mechanism. By the rotation of the vertical direction motor 39, the bending unit 40 moves upward and downward. Details of the bending unit 40 will be described later.

On the right part of the left-right moving table 37, a support part 60 that supports a tool device 70 is provided. The support part 60 protrudes rightward from the left-right moving table 37. On the right side part of the support part 60, a slanting plate 61 extending in the upper right or the lower left direction and parallel in the front-back direction is provided. The tool device 70 comprises a rail 71, and the rail 71 is provided on the lower surface of the slanting plate 61.

To the rail 71, a tool holding part 72 is coupled through a slider 71*a* so as to be movable. The tool holding part 72 is detachably attached to the slider 71*a*. The lower end part of the tool holding part 72 extends toward the wire guide 5, and a tool (the cutter T2 in the present embodiment) is attached to the lower end part. To the upper end part of the tool holding part 72, a tool driving motor 73 that drives the cutter T2 is attached. Above the slanting plate 61, a crank mechanism is provided. The crank mechanism comprises a rotary table 74 that rotates with a direction orthogonal to the slanting plate 61 as the rotation axis direction and a rod 75 that couples the rotary table 74 and the tool holding part 72. The cutter T2, the tool holding part 72 and the tool driving motor 73 are unitized. The cutter T2 has two opposing blades, and the two blades contact each other or separate from each other. The wire is disposed between the two blades, and the two blades are brought close to each other to cut the wire.

On the upper end part of the slanting plate 61, a motor 65 is provided on the upper surface side of the rotary table 74. The rotation shaft of the motor 65 passes through the slanting plate 61 and is coupled to the rotary table 74 in a position biased from the center of the rotary table 74. That is, the rotary table 74 rotates eccentrically. The rotary table 74 is coupled to the tool holding part 72 through the rod 75. The rotation of the motor 65 is converted to a movement in a direction parallel to the slanting plate 61 by the eccentric rotary table 74 and the rod 75 (crank mechanism), so that the tool holding part 72 moves in the direction parallel to the slanting plate 61 along the rail 71. The cutter T2 approaches the neighborhood of the exit of the wire guide 5 or separates from the neighborhood of the exit of the wire guide 5 or is driven by the driving by the tool driving motor 73, and processes the wire sent out forward from the wire guide 5.

The following may also be performed: The tool holding part 72 is detached from the slider 71*a*, that is, the unitized cutter T2, tool holding part 72 and tool driving motor 73 are detached from the coupling plate 18 and a different unit including a different tool (for example, a bending die or a spindle) is detachably attached to the slider 71*a*.

Figure 3:
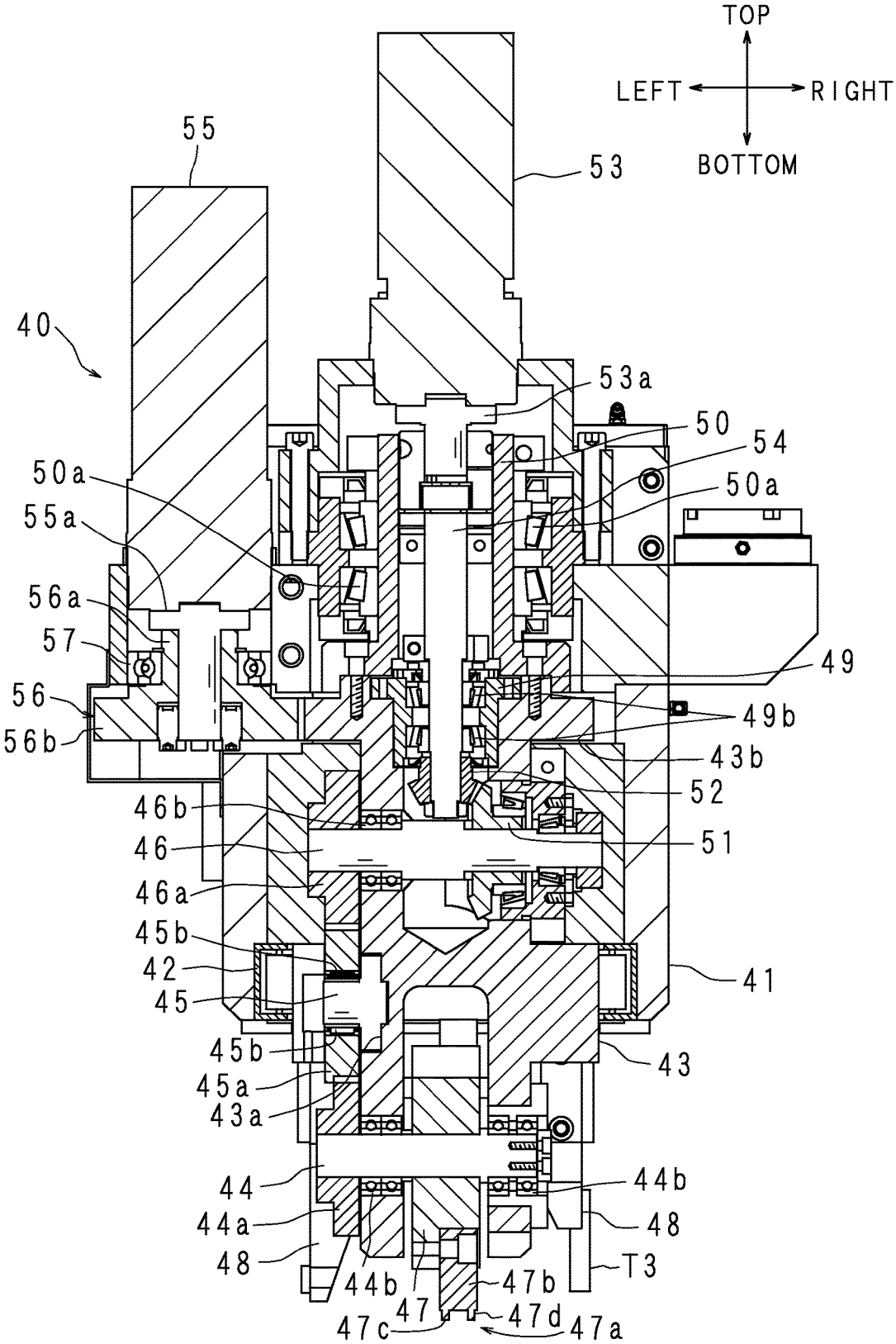
FIG. 3 is a front cross-sectional view briefly showing an example of non-limiting bending unit.
Figure 4:
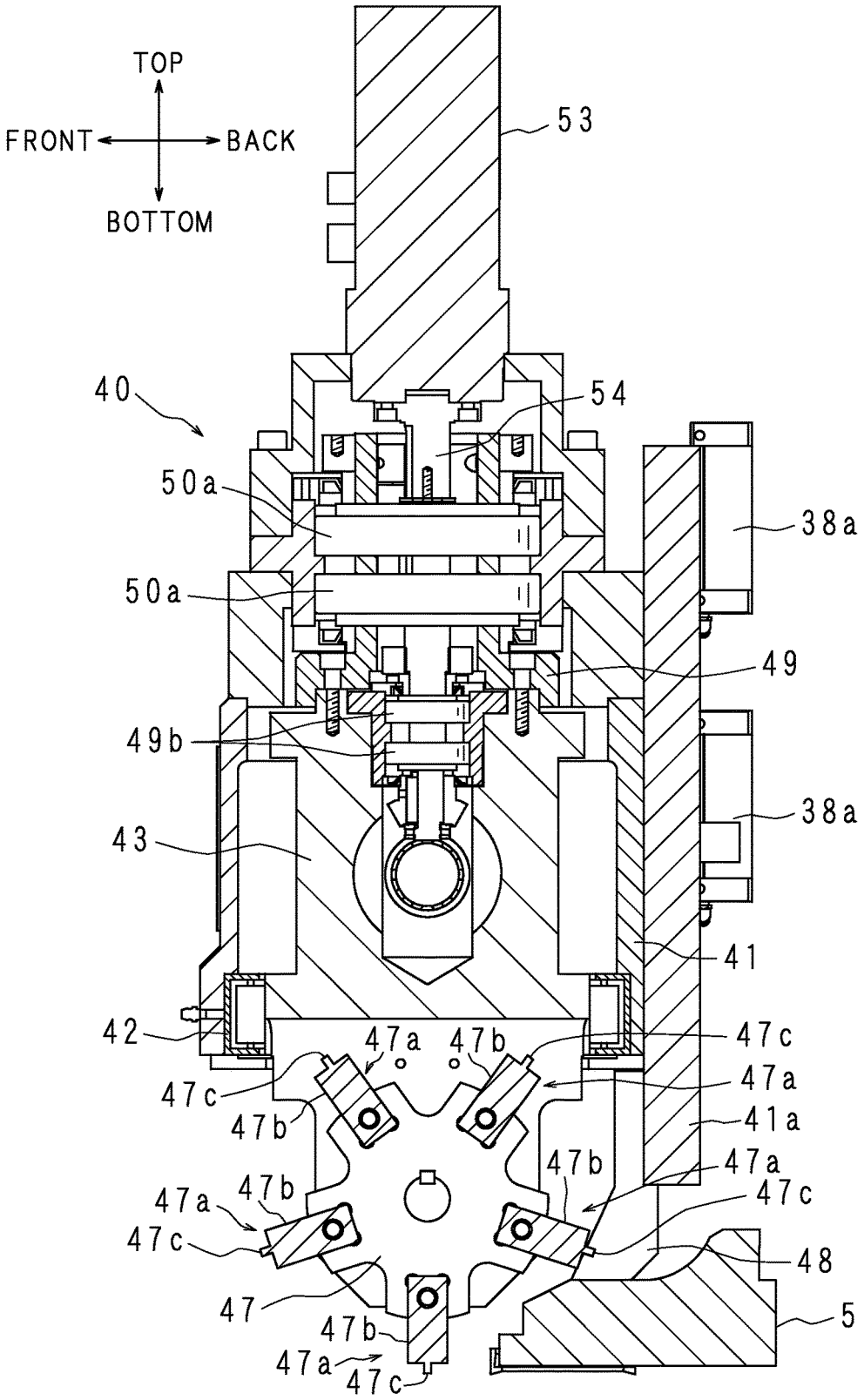
FIG. 4 is a side cross-sectional view briefly showing an example of non-limiting bending unit.

Next, the structure of the bending unit 40 will be described. FIG. 3 is a front cross-sectional view briefly showing an example of non-limiting bending unit 40, and FIG. 4 is a side cross-sectional view briefly showing an example of non-limiting bending unit 40. The bending unit 40 comprises a cylindrical housing 41 that extends vertically. The housing 41 is provided with a table 41*a* on the outer peripheral surface thereof, and the slider 38*a* is attached to the table 41*a*. In a lower part of the housing 41, a cylindrical member 43 is fitted through a rolling bearing 42 so as to be rotatable about the axis of the housing 41. Examples of the rolling bearing 42 include a needle bearing, a ball bearing and a roller bearing. Instead of the rolling bearing, a different kind of bearing such as a sliding bearing may be used. In an upper part of the housing 41, an insertion cylinder 50 in which a rod 54 described later is inserted is fitted through two bearings 50*a* so as to be rotatable about the axis of the housing 41. The insertion cylinder 50 extends upward from the upper end of the cylindrical member 43.

The cylindrical member 43 and the insertion cylinder 50 are coupled. The lower end part of the cylindrical member 43 protrudes downward from the housing 41.

Through the lower end part of the cylindrical member 43, a first shaft 44 passes in the radial direction of the cylindrical member 43. The first shaft 44 is rotatably supported by the cylindrical member 43 through a bearing 44*b*. On the middle part of the first shaft 44, a rotary table 47 is fitted. On the peripheral part of the rotary table 47, a plurality of pin tools 47*a* that bend the wire are installed next to each other in the circumferential direction. The pin tool 47*a* comprises a cylinder 47*b*, a cylindrical reference pin 47*c* and a cylindrical orbital pin 47*d*. The cylinder 47*b* protrudes outward in the radial direction of the rotary table 47. The cylindrical reference pin 47*c* protrudes from an end surface of the cylinder 47*b*. The cylindrical orbital pin 47*d* is separated from the reference pin 47*c* in the radial direction of the cylinder 47*b* and protrudes from the end surface. The cylinders 47*b* are only necessarily pillar-shaped, and may have a square pole shape or a different shape. The cylinders 47*b* (in other words, the pin tools 47*a*) are radially arranged on the rotary table 47.

The axial directions of the reference pins 47*c* are substantially parallel to the radial direction of the rotary table 47, and the diameters of the reference pins 47*c* are different from one another. The reference pins 47*c* and the orbital pins 47*d* are radially arranged on the rotary table 47. On the lower end part of the table 41*a*, two tool attachment parts 48 are respectively provided on one surface side and on the other surface side of the rotary table 47 with the rotary table 47 in between. A bending die T3 that processes the wire into a coil form is attached to the tool attachment parts 48. While FIG. 3 shows a condition where the bending die T3 is attached to only one of the tool attachment parts 48, it is to be noted that the bending die T3 may be attached to both of the tool attachment parts 48.

To the tool attachment parts 48, the bending die T3 that forms the coil part is attached, and the bending die T3 is required a predetermined rigidity. For this reason, the tool attachment parts 48 are provided not on the rotating cylindrical member 43 but on the fixed housing 41. The tool attachment parts 48 may be provided on a part of the housing 41 other than the table 41*a*.

One end part of the first shaft 44 protrudes to the outside of the cylindrical member 43. On the one end part of the first shaft 44, a first gear 44*a* is fitted. On the outside surface in the middle part of the cylindrical member 43, a concave part 43*a* is formed. The concave part 43*a* is located above the first shaft 44. In the concave part 43*a*, a second shaft 45 parallel to the first shaft 44 is fitted. On the second shaft 45, a second gear 45*a* is rotatably fitted about its axis through a roller 45*b*. The second gear 45*a* engages with the first gear 44*a*.

Above the second shaft 45, a third shaft 46 passes through the middle part of the cylindrical member 43. The third shaft 46 is parallel to the second shaft 45, and supported by the cylindrical member 43 through a bearing 46*b* so as to be rotatable about its axis. On the middle part of the third shaft 46, a first bevel gear 51 is fitted.

In the upper end part of the cylindrical member 43, a support cylinder 49 is coaxially fitted. Inside the support cylinder 49, two bearings 49*b* are supported.

To the upper end part of the housing 41, a rotary table driving motor 53 that supplies power to the rotary table 47 is attached. A rod 54 extending downward is coupled to a rotation shaft 53*a* of the rotary table driving motor 53. The rod 54 is inserted in the insertion cylinder 50, and is rotatably supported by the insertion cylinder 50 through the bearings 49*b*. The lower end part of the rod 54 is located in the neighborhood of the third shaft 46, and on the lower end part of the rod 54, a second bevel gear 52 is provided. The second bevel gear 52 engages with the first bevel gear 51.

The rotation of the rotary table driving motor 53 is transmitted to the rod 54, and by the first bevel gear 51 and the second bevel gear 52, the rotation direction is converted to the axial direction orthogonal to the cylindrical member 43, so that the third shaft 46 rotates. The rotation of the third shaft 46 is transmitted to a third gear 46*a*, a second gear 45*a* and a first gear 44*a*, so that the first shaft 44 rotates to rotate the rotary table 47. By rotating the rotary table 47, the pin tool 47*a* that includes the reference pin 47*c* with a desired diameter can be selected and located below the cylindrical member 43.

A cylindrical member driving motor 55 that rotates the cylindrical member 43 about the axis thereof is provided on the left side of the cylindrical member 43. The motor 55 comprises a rotation shaft 55*a* that is positioned underside of the motor 55. The axial direction of the rotation shaft 55*a* is parallel to the axial direction of the cylindrical member 43. A main driving gear 56 is fitted at the outside of the rotation shaft 55*a*. The main driving gear 56 comprises a cylindrical part 56*a* and a gear part 56*b* protruding outward in the radial direction from an end part of the cylindrical part 56*a*. The gear part 56*b* is located below the cylindrical part 56*a*. The cylindrical part 56*a* is fitted on the rotation shaft 55*a*, and rotatably supported in the casing of the cylindrical member driving motor 55 through a bearing 57. The gear part 56*b* protrudes into the housing 41 through an opening provided on the housing 41.

On the outer peripheral surface of the upper end part of the cylindrical member 43, a driven gear 43*b* is formed. The driven gear 43*b* engages with the main driving gear 56. The cylindrical member 43 is supported in the housing 41 so as to be rotatable about the axis thereof by the bearings 49*b* fitted in the support cylinder 49, the bearings 50*a* fitted on the insertion cylinder 50 and the rolling bearing 42 fitted in the lower end part of the housing 41.

The rotation of the cylindrical member driving motor 55 is transmitted to the cylindrical member 43 through the main driving gear 56 and the driven gear 43*b*, so that the cylindrical member 43 rotates about the axis thereof. By the rotation of the cylindrical member 43, the rotary table 47 also rotates about the axis of the cylindrical member 43, and the selected pin tool 47*a* also rotates. The reference pins 47*c* of the pin tools 47*a* are located on the rotation axis of the cylindrical member 43. For this reason, when the cylindrical member 43 rotates, the orbital pins 47*d* rotate around the reference pins 47*c*. When the wire is processed by the pin tool 47*a*, the wire is disposed between the reference pin 47*c* and the orbital pin 47*d*, and the cylindrical member 43 is rotated. By the rotation of the cylindrical member 43, the wire is pressed by the orbital pin 47*d* to be bent along the outer peripheral surface of the reference pin 47*c*.

The orbital pins 47*d* have a strength necessary for bending the wire. The curvature of the outer peripheral surface of the orbital pins 47*d* may be an arbitrary one since it does not affect the bending form of the wire.

The spring manufacturing machine comprises a control part (not shown), and based on an instruction from the control part, the wire sending unit 4, the tool devices 10 and the bending device 30 are driven. The control part outputs a drive signal to the rotary table driving motor 53 to rotate the rotary table 47 so that a predetermined reference pin 47*c* is located at the lower end of the cylindrical member 43 and located next to the wire sent out from the wire sending unit 4. The control part drives the tool devices 10 to rotate the orbital pins 47*d* so that the wire is bent along the outer peripheral surface of the reference pin 47*c*.

Since the diameters of the reference pins 47*c* provided on the rotary table 47 are different (that is, the curvatures thereof are different), the wire can be bent in a desired bending form by bending the wire along the outer peripheral surface of the reference pin 47*c* of the selected pin tool 47*a*. When a plurality of parts of the wire are bent with different curvatures, the rotary table 47 is rotated and the reference pin 47*c* having a desired curvature is selected, so that it is unnecessary to replace the pin tool 47*a*.

By rotating the front-back direction motor 34, the left-right direction motor 36 or the vertical direction motor 39 to move the rotary table 47 in the front-back direction, the left-right direction or the vertical direction, the relative positions between the wire, and the reference pin 47*c* and the orbital pin 47*d* can be adjusted. Moreover, by the bending die T3 attached to the tool attachment parts 48, the formation of the coil part (in other words, processing other than bending by the reference pin 47*c* and the orbital pin 47*d*) can also be realized. Moreover, the relative positions between the bending die T3 and the wire can be adjusted. A tool other than the bending die T3 may be attached to the tool attachment parts 48.

The control part is capable of adjusting the front-back, left-right and vertical positions of the tool devices 10 by rotating the front-back direction motor 16, the left-right direction motor 22 or the vertical direction motor 13. Moreover, the tool holding part 72 can be brought near the exit of the wire guide 5 or separated from the exit of the wire guide 5 by rotating the motor 65.

Second Embodiment

Figure 5:
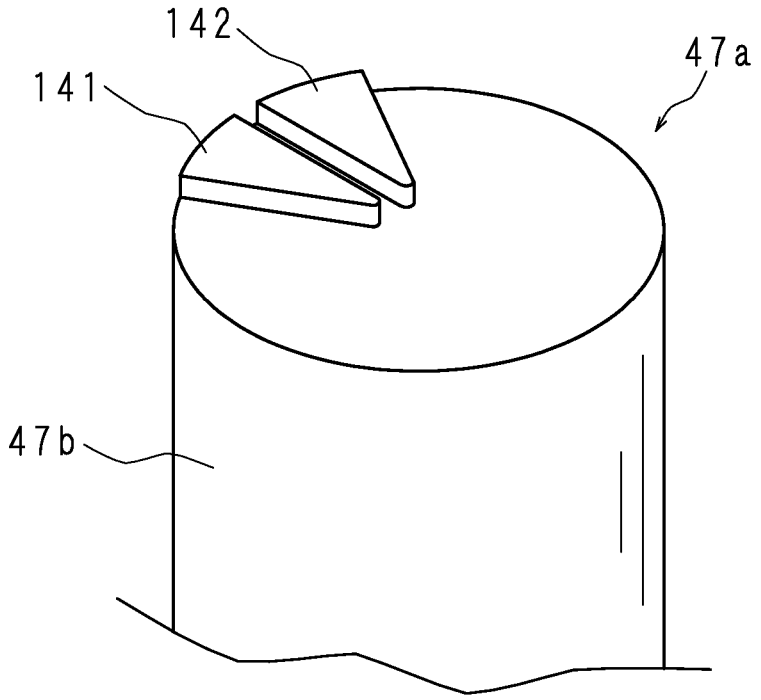
FIG. 5 is a perspective view briefly showing an example of non-limiting pin tool of a spring manufacturing machine according to a second embodiment.
Figure 6A:
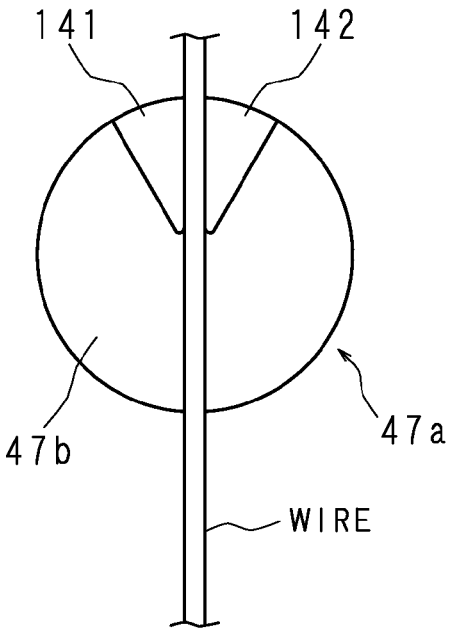
FIG. 6A is a bottom view explaining the operation of an example of non-limiting pin tool.
Figure 6B:
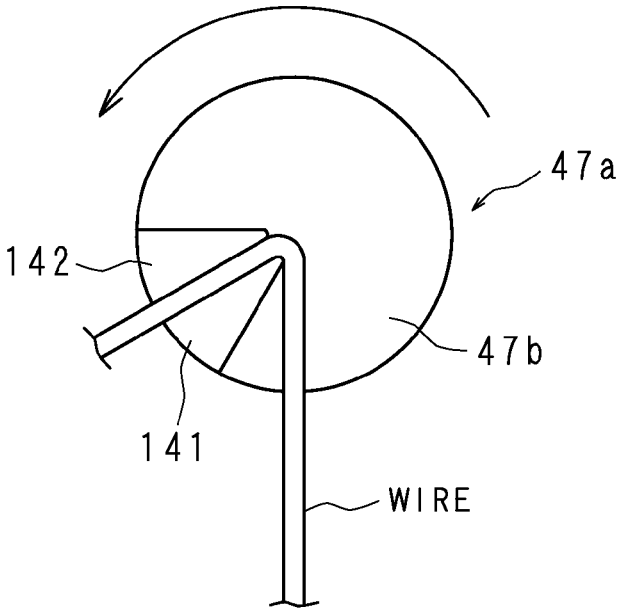
FIG. 6B is a bottom view explaining the operation of an example of non-limiting pin tool.

Hereinafter, the example embodiment will be described based on the drawings showing a spring manufacturing machine according to a second embodiment. FIG. 5 is a perspective view briefly showing an example of non-limiting pin tool 47*a*, and FIGS. 6A and 6B are bottom views explaining the operation of an example of non-limiting pin tool 47*a*.

In the peripheral part of the rotary table 47, a plurality of pin tools 47*a* are installed next to each other in the circumferential direction. On the end surface of the cylinder 47*b* of the pin tool 47*a*, a first protruding part 141 and a second protruding part 142 protruding from the end surface are juxtaposed in the circumferential direction. The first protruding part 141 and the second protruding part 142 are separated in the circumferential direction.

The first protruding part 141 and the second protruding part 142 each have a fan-shaped plate form when viewed from the bottom side. The central angle parts (tip parts) of the first protruding part 141 and the second protruding part 142 are located near the center of the cylinder 47*b*, and the arc parts of the first protruding part 141 and the second protruding part 142 are formed along the peripheral part of the cylinder 47*b*. The tip parts of the first protruding part 141 and the second protruding part 142 have a curved surface form. The central angles of the first protruding part 141 and the second protruding part 142 are substantially the same. Among the pin tools 47*a*, the central angles of the first protruding part 141 and the second protruding part 142 are different. That is, when one pin tool 47*a* and another pin tool 47*a* are compared, the above-mentioned central angles are different.

The pin tool 47*a* bends the wire in the following manner: As shown in FIG. 6A, the wire is disposed between the first protruding part 141 and the second protruding part 142. Then, by the rotation of the cylindrical member 43, the wire is bent along the tip part of the first protruding part 141 or the second protruding part 142. FIG. 6B shows a condition where by being pressed by the second protruding part 142, the wire is bent along the tip part of the first protruding part 141. When the cylindrical member 43 rotates reversely, by being pressed by the first protruding part 141, the wire is bent along the tip part of the second protruding part 142.

Since the central angles of the first protruding part 141 and the second protruding part 142 of the pin tools 47*a* provided on the rotary table 47 are different (that is, the curvatures thereof are different), by bending the wire along the tip part of the selected first protruding part 141 or second protruding part 142, the wire can be bent in a desired bending form. When a plurality of parts of the wire are bent with different curvatures, the rotary table 47 is rotated and the first protruding part 141 or the second protruding part 142 having a desired curvature is selected, so that it is unnecessary to replace the pin tool 47*a*.

In one pin tool 47*a*, the central angles of the first protruding part 141 and the second protruding part 142 may be different. In this case, the number of selectable curvatures can be doubled. When the wire is bent in the opposite direction with the same curvature, the wire is bent after rotated 180 degrees about the axis by driving the axial rotation motor 4*b*, and after the bending, the wire is reversely rotated 180 degrees about the axis.

The embodiments disclosed herein should be considered as illustrative in all respects and not restrictive. The technical features described in the embodiments may be combined together, and it is intended that all changes within the scope of the claims and the scope equivalent to the scope of the claims are embraced by the scope of the example embodiments.

What is claimed is:

1. A bending device, comprising a processing part having two protruding parts that protrude from an end surface of a pillar part and that bend a wire, wherein at least one of the protruding parts has a curved surface part, and the wire is disposed between the two protruding parts, the pillar part is rotated around an axis of the pillar part to bend the wire along the curved surface part, the bending device comprises plural processing parts, curvature of the curved surface part of the protruding part in each processing part are different, and the bending device further comprises:

a rotary part that supports the processing parts and rotates about an axis intersecting the length direction of the pillar part;

a cylindrical member that is cylindrical and contains the rotary part within an end part of the cylindrical member so as to be rotatable; and a mechanism that rotates the cylindrical member about an axis of the cylindrical member.

2. The bending device according to claim 1, wherein the plural processing parts are installed next to each other around a rotation axis of the rotary part.

3. The bending device according to claim 1, comprising:

a cylindrical housing that supports the cylindrical member so as to be rotatable about an axis of the cylindrical member; and a tool attachment part that is provided on an end part of the housing and that a tool to processes the wire is attached to.

4. The bending device according to claim 1, comprising a mechanism that moves the cylindrical member in a direction in which the wire is supplied or in a direction intersecting the direction.

5. A spring manufacturing machine, comprising:

the bending device according to claim 1; and a support wall that supports the bending device at one side and has an opening, wherein the wire is sent out from another side to the one side of the support wall through the opening.

6. The bending device according to claim 1, further comprising a shaft that passes through the cylindrical member in a radial direction of the cylindrical member and that is rotatably supported by the cylindrical member, wherein the rotary part is externally fitted to the shaft.

7. The bending device according to claim 1, wherein the axis of rotation of the rotary part is orthogonal to the axis of rotation of the cylindrical member.

* * * * *